United States Patent [19]

Morris

[11] 4,394,128

[45] Jul. 19, 1983

[54] METHOD OF SIZING POLYESTER YARN

[75] Inventor: Hal C. Morris, Warminster, Pa.

[73] Assignee: Rohm and Haas Company, Philadelphia, Pa.

[21] Appl. No.: 202,543

[22] Filed: Oct. 31, 1980

[51] Int. Cl.[3] ..... D01C 3/02; D06L 1/06; D06L 1/14; B65H 71/00

[52] U.S. Cl. ..... 8/138; 524/561; 524/562; 28/166; 28/168; 427/389.9; 428/224; 428/395

[58] Field of Search ..... 28/166, 7, 8; 8/138; 427/389.9, 401; 428/245, 265, 394, 224, 395; 260/29.6 TA; 524/561, 562

[56] References Cited

U.S. PATENT DOCUMENTS

| | | | |
|---|---|---|---|
| 2,807,865 | 10/1957 | Shipee | 28/76 |
| 3,676,207 | 7/1972 | Lofton et al. | 28/167 X |
| 4,015,317 | 4/1977 | Johnsen | 8/138 |
| 4,033,922 | 7/1977 | Baron et al. | 260/29.6 RW |
| 4,106,900 | 8/1978 | Perkins | 28/168 X |
| 4,239,671 | 12/1980 | Fink et al. | 260/29.6 TA |
| 4,248,755 | 2/1981 | Williams | 260/29.6 TA |
| 4,312,914 | 1/1982 | Guth | 427/381 X |

*Primary Examiner*—Michael R. Lusignan
*Attorney, Agent, or Firm*—Harold L. Greenwald; Michael B. Fein

[57] ABSTRACT

Taught is a method of sizing polyester yarn for weaving comprising the steps of applying thereto a latex having an acid pH and of a free radical initiated vinyl polymer having a weight average molecular weight of from about 300,000 to about 2,500,000, said polymer in dried film form being hydrophobic and not redispersible in a solution at a pH of from about 2 to 7 but redispersible by an aqueous alkaline medium, said polymer being prepared from monomers consisting essentially of by weight, 45–65% butyl acrylate a total of 28–45% styrene and/or methyl methacrylate and a total of 8–14% acrylic acid and/or methacrylic acid, and drying the yarn.

12 Claims, No Drawings

METHOD OF SIZING POLYESTER YARN

BACKGROUND OF THE INVENTION

This invention relates to the sizing or dressing of fibers, filaments, and yarns whether of spun or continuous filament type, to render such textile materials amenable to textile operations, for example, twisting, doubling, weaving, knitting, braiding and so forth. It is particularly concerned with sizes of the removable type which are adapted to be applied to polyester yarns and especially yarns for use in water jet looms.

Various water-soluble or highly water dispersible polymeric colloidal substances, such as starch, polyvinyl alcohol and acid rich acrylic copolymers have been used for the sizing of yarns including moderately hydrophobic yarns such as nylon yarn, but such materials generally show insufficient adhesion to the more hydrophobic yarns such as polyester. This lack of adhesion requires the application of excessive amounts of sizing material to protect the filaments or fibers or to compensate for the tendency for the size to rub off on guides and other surfaces of the textile fabricating machinery. A suitable polymeric size must not be so hard or brittle as to shed particles during passage through the textile fabricating machinery nor adhere to the metal in preference to the fiber or yarn and in this way lead to deposits of size materials being left on metal drives or drying drums during the processing. Sizing of yarns for use in water jet looms presents particular problems because the shed opening on the looms is very small and electronic controls may be so fine that fuzzy yarns either transfer with the jets or tend to trip the stop motion in electronically controlled units which stop the loom abruptly.

The acrylic copolymer size of the instant invention has excellent adhesion to polyester yarn and does not require extremely stringent drying conditions in order to develop good water resistance. Despite being highly hydrophobic, the polymer is readily removable with a mild alkaline scour and thus is an excellent warp size for polyester yarns to be woven on a water jet loom, or on a conventional shuttled or shuttleless loom. Additionally, the polymer is tack-free in film form and being a latex emulsion, as prepared, it is readily amenable to dilution and dries easily under moderate conditions to a water-resistant tack-free polymer.

BRIEF DESCRIPTION OF THE INVENTION

There is described a method of sizing polyester yarns for weaving comprising the steps of applying thereto a latex and drying the so treated yarn. The latex has an acid pH and is a latex of a free radical initiated vinyl polymer having a weight average molecular weight between about 300,000 and about 2,500,000. Said polymer in dried film form is hydrophobic and is not redispersible in an aqueous solution at a pH from about 2 to about 7 but is redispersible in an aqueous alkaline medium. The polymer is prepared from monomers consisting essentially of, by weight, 45–65% butyl acrylate, a total of 28–45% styrene and/or methyl methacrylate and a total of 8–14% acrylic acid and/or methacrylic acid.

DETAILED DESCRIPTION

The polymer latex of the instant invention is made preferably by a gradual addition thermal process at about 39% solids following conventional emulsion polymerization procedures such as taught in the books entitled "Emulsion Polymerization" by D. C. Blackley (Wiley, 1975) and S. A. Bovey et al (Interscience Publishers, 1965) both herein incorporated by reference. The polymer is preferably a linear polymer free of crosslinks and branch points. The polymer is prepared from monomers consisting essentially of, by weight, 45–65% butyl acrylate, 28–45% styrene or methyl methacrylate or a mixture thereof, 8–14% acrylic acid or methacrylic acid or a mixture thereof; preferably the monomers consist essentially of 50–60% butyl acrylate, 28–40% styrene and 10–13% acrylic acid or methacrylic acid. The polymer has a weight average molecular weight of from about 300,000 to about 2,500,000 with 500,000 to about 2,000,000 being preferred and 600,000 to 1,500,000 being most preferred.

The polymer latex size forms a film on a polyester yarn, preferably polyethtylene terephalate, having excellent adhesion and flexibility thus providing a hard, tough protective film unaffected by the abrasive action of looms, particularly water jet looms, and by humidities up to 100%. The polymer is easily removed by scouring with dilute aqueous solutions of alkaline materials.

The amount of copolymer applied to the textile material may vary from about 1 to about 20% by weight depending on the purpose for which the application is intended and on whether or not auxiliary conditioning or sizing agents are included in the composition when it is applied to the textitle. The latex may be applied by spraying, dipping, padding, by sizing rolls, transfer rolls or the like. An entire warp may be passed through a conventional slasher or a yarn may be individually treated in a single end sizer. The latex may have a concentration of 1–25% by weight solids in the aqueous system and excess may be removed, such as by squeeze rolls or wipers, and the treated yarn may then be dried. Drying may be effected by any suitable means such as by heated air or drying cans. Drying may be effected at a wide range of temperatures such as from 70°–120° C. The aqueous latex may be applied at room temperature or at elevated temperatures such as up to about 80° C. For warp sizing of spun yarns the preferred proportion of polymer applied to the yarn is from 5–15% by weight of the initial weight of the yarn. For the sizing of continuous filament yarns, including water jet loom sizing, the preferred proportion is from about 1% to about 10% copolymer on the weight of the yarn. The higher amount of size is needed for fine (low) denier zero or low twist yarn.

The copolymer of this invention may be applied to textiles, such as yarns, fibers, or filaments, threads or cords, felts, fabrics or the like, to modify their properties and especially to render them more amenable to textile processing operations. The copolymer may be applied to threads or cords to protect them during selling operations. Although not necessary, auxilliary materials may be incorporated into the latex such as surfactants or water dispersible lubricants, including sulfonated oils, self-dispersible waxes, swelling or plasticizing agents for the yarn, etc.

The article obtained, after application of the sizing composition to the textile material and drying, is essentially free from the disadvantage of developing static charges and loss of sizing material by transfer to guides or by shedding. Further, the sizing material is readily removed by common scouring operations because of the ready solubility in aqueous alkaline medium despite its marked hydrophobicity and insolubility in acid medium. Even mildly alkaline scour solutions, such as 0.15% soda ash, are completely effective in removal of this polymer. Such mildly alkaline solutions may have a pH about 10.

Various tests are employed to gauge the suitability of the polymer latexes for use in sizing polyester yarn. The test methods are described below; in the examples there are data comparing polymers of the instant invention with materials of the prior art and with examples of polymer latices outside of the bounds of the instant invention.

The adhesion of the polymer to the yarn as measured by the Sand Tumble Test, described below, gauges how well a yarn bundle will resist abrasion on the loom. Run under dry conditions the test relates to performance on a standard loom and run under wet conditions the test relates to performance on a water jet loom. A value of 50 is considered acceptable although 75 is preferred and values about 100 are most preferred.

Adhesion of Mylar Test is indicative of adhesion to a polyester substrate since Mylar is a polyester substrate. The Crinkle Test gives the tendency of the polymer to flake from the substrate under flexing, thus simulating a yarn going over a roller or a guide. Flaking under such conditions would cause a weak spot in the yarn and thus lead to breaks in the yarn in the loom. The Scrape Test is to simulate the action at drop wires or a reed in the loom and also gives a gauge of the film toughness which property is required for runability in a mill.

Water Resistance Tests measure a property needed for good performance in a water jet loom. Low water resistance is indicative of high swelling which leads to a markedly weaker film and thus to a weak sized yarn. The Moisture Regain measurement, being at 95% relative humidity, additionally indicates the stability of the sized yarn to changes in ambient conditions such as from season to season or from dry day to humid day.

Tack Test measures the ability of the sized and dried yarn to be rolled on a beam while warm and then be unrolled from the beam without sticking.

Removability of the size is, of course, essential with the final test of removability from the sized yarn being most important. The size should be completely removable from the yarn.

The polymer of the instant invention is applied to the yarn in the form of a latex of particles usually about 0.07 to about 0.25 microns diameter, with 0.10 to 0.18 being preferred and about 0.14, or a range within about 0.02 of that value, being most preferred. This highly hydrophobic polymer composition is applied at acid pH and is scoured at basic pH thus the polymer is intrinsically stronger, as a size, than a solution polymer would be in this application. The solution polymer would have to be at least partially neutralized to be in aqueous solution and thus would be highly swollen and weaker than the very hydrophobic polymer at low pH, of the instant invention. If attempts are made to have the solution polymer be more hydrophobic and thus marginally soluble then the difficulty of scouring increases. A further advantage of utilizing a latex versus an alkaline solution or dispersion of a polymer is that less severe drying conditions are required for the latex, a particularly significant energy saving.

Alternative embodiments of the instant invention may employ other monomers in the preparation of the polymer latex. In these embodiments the acid content and identity is the same as in the above-described embodiments. Replacements for the butyl acrylate, styrene and methyl methacrylate are made on the basis that the range of glass transition temperatures (Tg, calculated for a high molecular weight polymer) and solubility parameter are to remain within the range implicit in the compositional range for the embodiment taught above. Likewise preferred and more preferred are ranges of Tg and solubility parameter corresponding to the preferred and more preferred compositional ranges recited above.

"Polymer Handbook", 2nd Edition, J. Brandrup and E. H. Immergut, editors (John Wiley & Sons, New York, 1975) section IV, part 15, entitled "Solubility Parameter Values" by H. Burrell, on pages IV-337 to IV-359, herein incorporated by reference, defines solubility parameter, describes how it is determined or calculated, contains tables of solubility parameters and gives further references to scientific literature on solubility parameters. The solubility parameter is the square root of the cohesive energy density which in turn is the numerical value of the potential energy of 1 cc of material, the potential resulting from the Van der Waals attraction forces between the molecules of a liquid or solid. Burrell describes a number ways of calculating solubility parameters from experimentally determined physical constants and two ways of calculating them from the structural formula of a molecule. The structural formula methods are normally used when the data for the calculation from physical constants are not available or are considered particularly unreliable. Calculation from the structural formula utilizes tables of group molar attraction constants such as those given on page IV-339. The table of Small is preferred. The solubility parameter concept may be considered an extension of the old rule "like dissolves like" recognized from the early days of chemistry.

The calculated Tg of a polymer is determined by the equation of T. G. Fox, Bull. Am. Physics Soc. 1,3, page 123 (1956) based on the Tg of homopolymers of the individual monomers in the copolymer. Tables of the Tg of homopolymers are given in "Polymer Handbook", section III, part 2, by W. A. Lee and R. A. Rutherford herein incorporated by reference.

Monomers which can be used in these alternative embodiments are preferably vinyl aromatic hydrocarbons, such as vinyl toluene and alpha methyl styrene, alkyl acrylates wherein the alkyl group has 1 to 8 carbon atoms, such as ethyl acrylate, propyl acrylate, and 2-ethylhexyl acrylate, and alkyl methacrylates having 2 to 4 carbon atoms, such as ethyl methacrylate and isobutyl methacrylate.

In the following examples parts and percentages are by weight and temperature in degrees Celsius unless otherwise indicated. The following examples illustrate the invention and are not to be construed as limiting the invention thereto. As given below, a general method was followed in the preparation of yarns and films; these methods were followed throughout the examples unless an exception is noted in a given example. The same is true of the general test methods given below.

PREPARATION OF MATERIALS

Sized Yarns: The latex, at a pH of ca. 2.0 to 2.5 as prepared, is diluted to 8% resin solids with water and applied to polyester filament yarn at room temperature on a laboratory size single end slasher. The slasher employs a double squeeze and consists of an immersion bath followed by a metal drum and two Teflon®- coated drums, the first squeeze being between the metal drum and the first Teflon coated drum and the second squeeze between the two Teflon coated drums. The slasher is run at 4 M/min and the sized yarn is dried 15 seconds thru a tube dryer set at 115° C. All sized yarn is conditioned one day at 21° C. and 60% R.H. before testing.

Film Preparation: 20 mil films are prepared by diluting the latex with water to the necessary solids content per volume. The diluted latex is then poured into a polypropylene culture dish, placed in a dust free area on a level surface, and air dried for 4 days or until a clear film is obtained. Thinner films (about 0.2 mils) are prepared by pouring a 15% solids latex, obtained by dilution with warm water (54° C.), onto a two mil Mylar ® sheet. The films are room dried overnight, then oven dried for one minute at 110° C.

TEST METHOD

Adhesion by Sand Tumble Test: The sized yarns are evaluated for wet and dry adhesion using laboratory sand tumble tests. Dry—Duplicate 3 yd. skeins of the sized yarn are placed in an 8 oz. jar containing 150 g of coarse sand, rotated for 30 minutes on an Atlas Launder-ometer, removed and rated for % of the fiber bundle remaining intact. Wet—The same procedure is followed except the jar now contains 50 g of sand and 150 g water. Ratings are made the same way.

Adhesion to Mylar: The adhesion of the thin film is determined by two methods, scrape and crinkle. The scrape test consists of scraping the film with a razor blade and counting the number of strokes required to remove the polymer film from the polyester sheet. The crinkle test is designed to measure the film adhesion to polyester sheet by crumbling the sheet by hand and flattening it, noting any film separation from the Mylar. In the scrape test the results are classed as follows: Poor 1-2, Fair 3-4, Good 5 and Excellent—6 or more strokes. Crinkle test results are judged: Excellent—no change or Fair—cracks and slight film removal.

Water Resistance: The wet sand tumble test, previously noted, is a preliminary screen test of the water resistance. All additional testing of this property is conducted on the polymer films, either free or on Mylar, as follows: One inch squares of both the free and Mylar films are placed in 30° C. water for 30 minutes and evaluated for any change in clarity, toughness, adhesion, and size using the following ratings: Excellent=no change; Good=film swelling and Fair=swelling and loss of toughness. The 20 mil free film is also evaluated for moisture regain when first bone dried and then subjected to 95% RH in a constant humidity chamber; the film is also observed for degree of haze developed.

Tack: The tackiness of the polymer is evaluated, immediately following one minute drying at 110° C., on the film cast on Mylar. For this evaluation, two films on Mylar are pressed film/film and then opened to gauge adhesion.

Removeability of the Size: This property is evaluated by two methods, alkali solubility of the film, and an actual scouring of sized yarn. *Solubility of the film* is determined by placing of a ¾" square of the 20 mil free film in a 1% $Na_2CO_3$ solution at 70° C. and recording the time it takes to dissolve up to 20 min. at which time the level of incomplete solution is gauged. The sized yarn is evaluated for size removal by scouring the yarn at 70°-74° C. for 30 minutes in a 1.0% $Na_2CO_3$ and 0.1% surfactant (Triton ®-X-100) bath with mild agitation. The yarns are rinsed five minutes in warm water (54° C.) and then cold water. The degree or removeability is determined by dyeing scoured and control yarns in Basic Red #14 at 60° C. and observing the dye pickup.

The following abbreviations are used in the examples below: BA-butyl acrylate, St-styrene, AA-acrylic acid, MMA-methyl methacrylate, MAA-methacrylic acid, EA-ethyl acrylate, EGDMA-ethyleneglycol dimethacrylate.

Example I—Copolymers Containing 12% Acrylic Acid

Film and yarn are prepared using acrylic copolymer latex samples described in Table I below. The yarn being sized is Milliken textured polyester yarn, Saluda 373, 70 Denier, 33 filament, 1 twist. The test results, in Table I below, show that the samples varying in butyl acrylate content from 45% to 50.5% are all suitable sizing polymers compared to two commercial materials (1D, 1E). All of the examples exhibited no tack, except 1D which had slight tack when hot. The viscosity average molecular weight of the polymer of Example 1A is about 1.2 to 1.3 million.

Example II—Copolymers of 12% Methacrylic Acid

Using the same yarn as in Example I, methacrylic acid containing polymers having 55-60% butyl acrylate are tested with the results found in Table II. An additional observation made is that the methacrylic acid samples produced less foam in the bath and during handling than the corresponding acrylic acid samples. All of the examples exhibited no tack. The weight average molecular weight of the polymer in Example 2C is about 600,000 to 700,000.

TABLE I

| Ex. | Composition | Sand Tumble Dry | Sand Tumble Wet | Film Solubility (min.) | Removability from yarn | Water Resistance of films 20 mil | Water Resistance of films Mylar | Adhesion to Mylar Scrape | Adhesion to Mylar Crinkle | Moisture Regain (%) |
|---|---|---|---|---|---|---|---|---|---|---|
| 1A[2] | 50.5 BA/37.5 St/12 AA | 100 | ca. 100 | Partial[1] | Complete | Exc. | No Change | Exc. | Exc. | 3.0 |
| 1B[2] | 50.5 BA/37.5 St/12 AA | 75-100 | 75 | Partial | Complete | Good | No Change | Exc. | Exc. | 3.7 |
| 1C | 45 BA/43 MMA/12 AA | 75-100 | 75 | <19 | Complete | Good-Exc. | No Change | Exc. | Exc. | 3.5 |
| 1D | Polyester[3] | 50 | 25 | <4 | Complete | Good | No Change | Exc. | Exc. | 22.0 |
| 1E | Eastman MPS Acrylic[4] | ca. | 75 | <20 | Complete | Exc. | No | Poor | Good | 11.0 |

TABLE I-continued

| Ex. | Composition | Sand Tumble Dry | Sand Tumble Wet | Film Solubility (min.) | Removability from yarn | Water Resistance of films 20 mil | Water Resistance of films Mylar | Adhesion to Mylar Scrape | Adhesion to Mylar Crinkle | Moisture Regain (%) |
|---|---|---|---|---|---|---|---|---|---|---|
| | ABCO FT-2B | 100 | | | | | Change | | | |

[1]Partial - some film remaining after 20 minutes.
[2]Latex particle diameter is 0.10 micron in Example 1A and 0.21 in Example 1B.
[3]Applied as an 8% solids solution at a pH of 6.
[4]Applied as an 8% solids solution at a pH of 8.

TABLE II

| Ex. | Composition | Sand Tumble Dry | Sand Tumble Wet | Film Solubility (min.) | Removability from yarn | Water Resistance of films 20 mil | Water Resistance of films Mylar | Adhesion to Mylar Scrape | Adhesion to Mylar Crinkle | Moisture Regain (%) |
|---|---|---|---|---|---|---|---|---|---|---|
| 2A[1] | 57 BA/31 St/12 MAA | 75 | 75 | Partial | Complete | Exc. | No Change | Good-Exc. | Exc. | 2.0 |
| 2B | 60 BA/28 St/12 MAA | 50-75 | 50-75 | Partial | Complete | Exc. | No Change | Exc. | Exc. | 2.0 |
| 2C[1] | 57 BA/31 St/12 MAA | ca. 100 | ca. 100 | Partial | Complete | Exc. | No Change | Exc. | Exc. | 2.1 |
| 2D | 55 BA/33 St/12 MAA | 75-100 | 75 | Partial | Complete | Exc. | No Change | Good-Exc. | Fair | 1.8 |

[1]Latex particle diameter is 0.08 micron in Example 2A and 0.13 micron in Example 2C.

Example III—Compositional Variations

Polymer latexes of various compositions, as reported in Table III below, are used to prepare films and size yarns as in Example I. Example 3D, having 4% acid in the copolymer, exhibits an insoluble film and less than complete removability from the yarn upon scouring the slightly hazy thin film on Mylar in the water resistance test. Example 3E, having 16% acid in the copolymer, also shows less than complete removability from the yarn on scouring and in addition has limited water resistance shown by both the 20 mil film and the thin film results. The only examples, in this group, exhibiting tack are 3C which has some tack when hot and 3D which has some tack even when cooled to room temperature.

TABLE III

| Ex. | Composition | Sand Tumble Dry | Sand Tumble Wet | Film Solubility (min.) | Removability from yarn | Water Resistance of films 20 mil | Water Resistance of films Mylar | Adhesion to Mylar Scrape | Adhesion to Mylar Crinkle | Moisture Regain (%) |
|---|---|---|---|---|---|---|---|---|---|---|
| 3A | 50.5 BA/37.5 MMA/12 AA | 75 | 75 | <15 | Complete | Good-Exc. | No Change | Good | Exc. | 5.0 |
| 3B | 48.5 BA/37.5 St/44 AA | 100 | ca. 100 | Partial | Complete | Exc. | No Change | Fair-Good | Good | 4.0 |
| 3D | 58.5 BA/37.5 St/4 AA | 75 | 75+ | Insol. | Almost Complete | Exc. | Sl. Haze | Exc. | Exc. | 4 |
| 3E | 46.5 BA/37.5 St/16 AA | 100 | 100 | Partial | Almost Complete | Fair-Good | Hazy | Good-Exc. | Exc. | 6 |

I claim:

1. A method of sizing polyester yarn for weaving comprising the steps of (1) applying thereto a free radical initiated vinyl polymer latex having an acid pH and a weight average molecular weight from about 300,000 to 2,500,000; said polymer in dried film form being hydrophobic and not redispersible in a solution at a pH from about 2 to 7 but redispersible by an aqueous alkaline medium, said polymer being prepared from monomers consisting essentially of, by weight, 45 to 65% butyl acrylate, 28 to 45% styrene and/or methyl methacrylate, and 8 to 14% acrylic acid and/or methacrylic and (2) drying the yarn.

2. The method of claim 1 in which said monomers consist essentially of butyl acrylate, styrene, and acrylic acid and/or methacrylic acid.

3. The method of claim 1 in which said monomers consist essentially of butyl acrylate, methyl methacrylate; and acrylic acid and/or methacrylic acid.

4. The method of claim 2 in which said acid is acrylic acid.

5. The method of claim 2 in which said acid is methacrylic acid.

6. The method of claim 3 in which said acid is acrylic acid.

7. The method of claim 3 in which said acid is methacrylic acid.

8. The method of claim 1 in which said monomer consist essentially of 50 to 60% butyl acrylate, 28 to 40% styrene and 10 to 13% acrylic acid.

9. The method of claim 1 in which said monomers consist essentially of about 50 to 60% butyl acrylate, 28 to 40% styrene and 10 to 13% methacrylic acid.

10. Polyester yarn prepared by the method of claim 1, 2, 3, 4, 5, 6, 7, 8, or 9.

11. A method of weaving comprising the steps of preparing a polyester yarn in accordance with the method of claim 1, 2, 3, 4, 5, 6, 7, 8, or 9, weaving the yarn into fabric, and removing said vinyl polymer therefrom by an aqueous alkaline solution.

12. A method in accordance with claim 11 in which the step of weaving is conducted by means of a water jet loom.

* * * * *